US006454431B1

(12) United States Patent
Grossman et al.

(10) Patent No.: US 6,454,431 B1
(45) Date of Patent: Sep. 24, 2002

(54) LIGHTING SYSTEM

(75) Inventors: Steven H. Grossman, Rockville; Richard E. Grossman, Bethesda, both of MD (US)

(73) Assignee: Cathode Lighting Systems, Inc., Gaithersburg, MD (US)

( * ) Notice: Subject to any disclaimer, the term of this patent is extended or adjusted under 35 U.S.C. 154(b) by 0 days.

(21) Appl. No.: 09/285,080

(22) Filed: Apr. 2, 1999

Related U.S. Application Data

(63) Continuation of application No. PCT/US97/17723, filed on Oct. 6, 1997, and a continuation-in-part of application No. 08/725,516, filed on Oct. 4, 1996, which is a continuation-in-part of application No. 08/103,591, filed on Aug. 9, 1993, now Pat. No. 5,564,818, which is a continuation-in-part of application No. 07/879,878, filed on May 7, 1992.

(51) Int. Cl.[7] ..... F21S 8/00

(52) U.S. Cl. ..... 362/151; 362/150; 362/219; 362/221; 362/225; 362/252; 362/263

(58) Field of Search ..... 362/151, 150, 362/160, 152, 225, 221, 240, 252, 260, 219, 263, 216; 445/22, 26

(56) References Cited

U.S. PATENT DOCUMENTS

| | | | | |
|---|---|---|---|---|
| 1,880,230 A | | 10/1932 | Beck | |
| 1,940,368 A | | 12/1933 | Page | |
| 2,017,273 A | | 10/1935 | Boucher | |
| 2,139,884 A | | 12/1938 | Deans | |
| 2,298,824 A | | 10/1942 | Darley | |
| 2,345,234 A | | 3/1944 | Carter Jr. | |
| 2,769,897 A | | 11/1956 | Rzeszutko | |
| 2,922,029 A | | 1/1960 | Eschelbach et al. | |
| 3,117,728 A | | 1/1964 | Waldbauer | |
| 3,202,814 A | | 8/1965 | Cegila | |
| 3,735,122 A | | 5/1973 | Ebin et al. | 240/51.12 |
| 3,956,665 A | | 5/1976 | Westphal | 315/95 |
| 4,004,185 A | | 1/1977 | Edmondson et al. | 315/105 |
| 4,117,377 A | | 9/1978 | Jimerson et al. | 315/209 |
| 4,346,331 A | | 8/1982 | Hodge | 315/158 |
| 4,413,311 A | | 11/1983 | Orenstein | 362/219 |
| 4,545,774 A | * | 10/1985 | Van Gils et al. | 313/493 |
| 4,554,619 A | | 11/1985 | Bansbach et al. | 362/222 |

(List continued on next page.)

*Primary Examiner*—Stephen Husar
*Assistant Examiner*—Bertrand Zeade
(74) *Attorney, Agent, or Firm*—Dickstein Shapiro Morin & Oshinsky LLP

(57) ABSTRACT

A modular cove lighting system is formed of tubular fluorescent light fixtures connected together in parallel. The modular system is capable of providing uniform illumination along its length. The modular system advantageously may include straight lamps, curved lamps (including lamps forming 90° angles), and/or hinged lamp fixtures. The system may be constructed with lamps that are illuminated completely from end to end, which can then be lined up end-to-end to create the illusion of one continuous lamp. Through special matching of ballasts and appropriate lamps, the lamps will dim evenly with each other, regardless of the lengths and shapes of the lamps. Each lamp and ballast is completely contained in a casing to form a cove lighting module. Multicolor systems formed of one or more light fixtures are also disclosed. A recessed light fixture is also disclosed.

6 Claims, 14 Drawing Sheets

U.S. PATENT DOCUMENTS

| | | | | | |
|---|---|---|---|---|---|
| 4,569,004 | A | | 2/1986 | Peterson | 362/216 |
| 4,587,600 | A | * | 5/1986 | Morten | 362/219 |
| 4,592,702 | A | * | 6/1986 | Bogage | 416/247 |
| 4,712,165 | A | | 12/1987 | Cetrone | 362/147 |
| 4,727,459 | A | | 2/1988 | Palumbo | 362/260 |
| 4,746,841 | A | | 5/1988 | Ogawa | 315/102 |
| 4,751,434 | A | | 6/1988 | Helling et al. | 315/183 |
| 4,940,921 | A | | 7/1990 | Helling et al. | 315/219 |
| 4,947,301 | A | | 8/1990 | Steele | 362/219 |
| 5,025,355 | A | | 6/1991 | Harwood | 362/147 |
| 5,057,981 | A | | 10/1991 | Bowen et al. | 362/219 |
| 5,060,125 | A | | 10/1991 | Cowie et al. | 362/218 |
| 5,075,823 | A | | 12/1991 | Chomyn | 362/2 |
| 5,089,943 | A | | 2/1992 | Woefelschneider | 362/216 |
| 5,097,401 | A | | 3/1992 | Eppler | 362/298 |
| 5,144,205 | A | | 9/1992 | Motto et al. | 315/244 |
| 5,155,668 | A | | 10/1992 | Tanner et al. | 362/183 |
| 5,165,053 | A | | 11/1992 | Jones | 315/224 |
| 5,226,724 | A | | 7/1993 | Kamarek | 362/260 |
| 5,370,546 | A | | 12/1994 | Evanisko | 439/226 |
| 5,436,816 | A | | 7/1995 | Nagano | 362/219 |
| 5,448,460 | A | | 9/1995 | Belfer et al. | 362/225 |
| 5,541,823 | A | | 7/1996 | Fallon et al. | |
| 5,564,818 | A | * | 10/1996 | Grossman et al. | 362/221 |

* cited by examiner

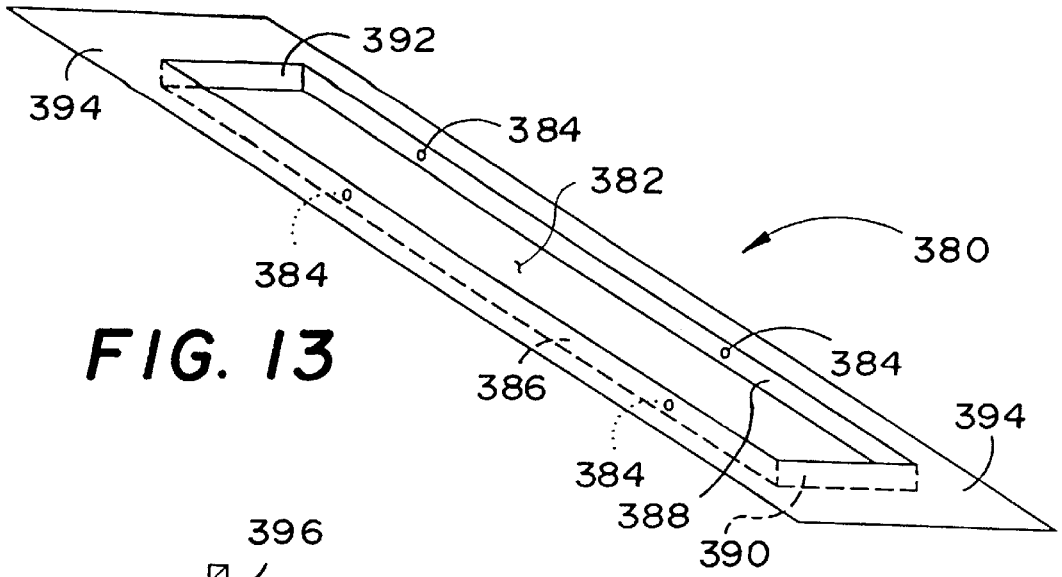
FIG. 13
FIG. 14
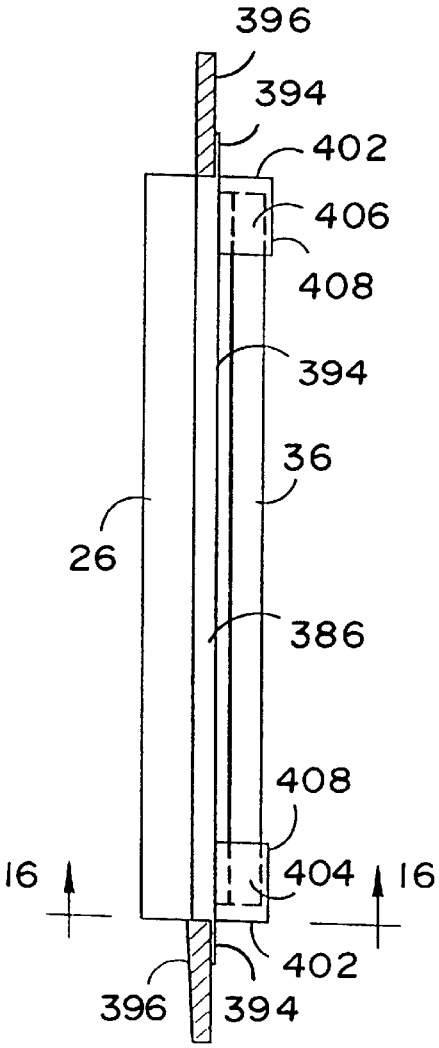
FIG. 15
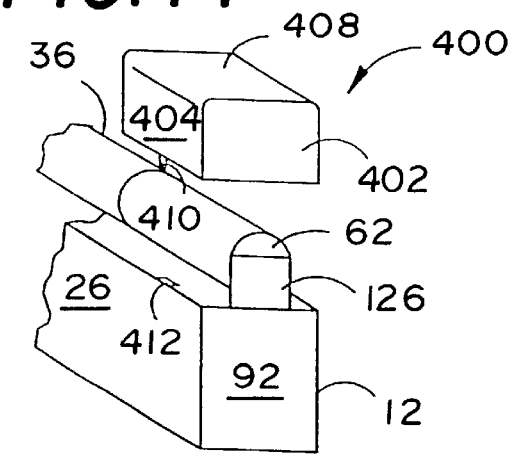
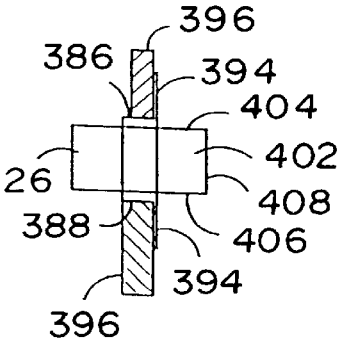
FIG. 16

FIG. 21
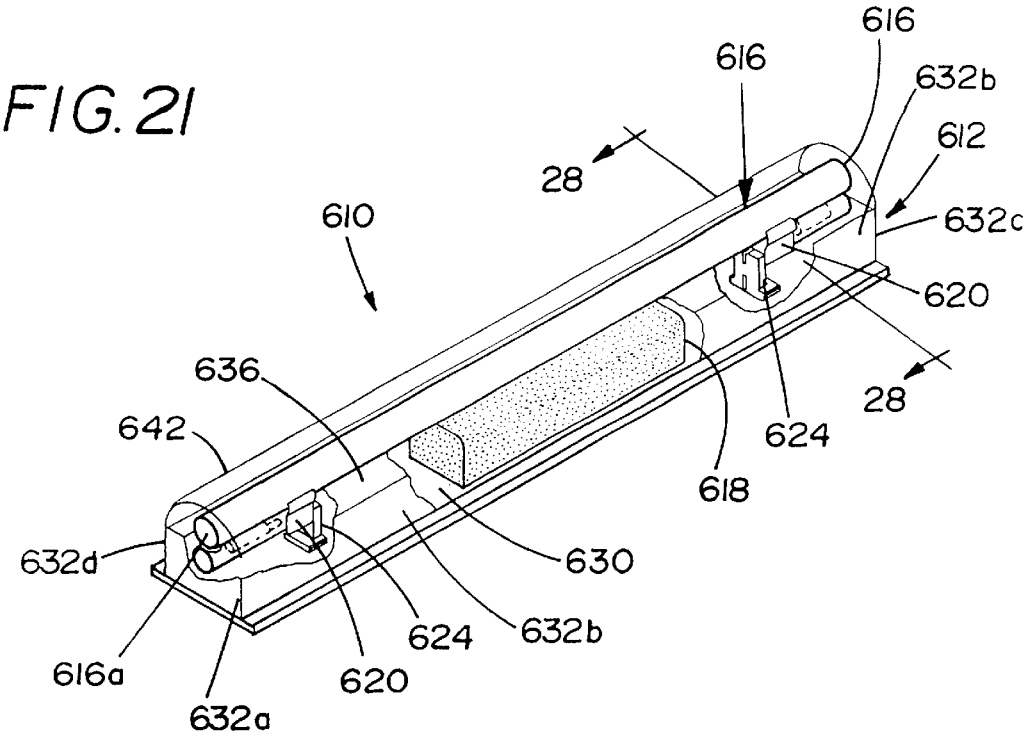
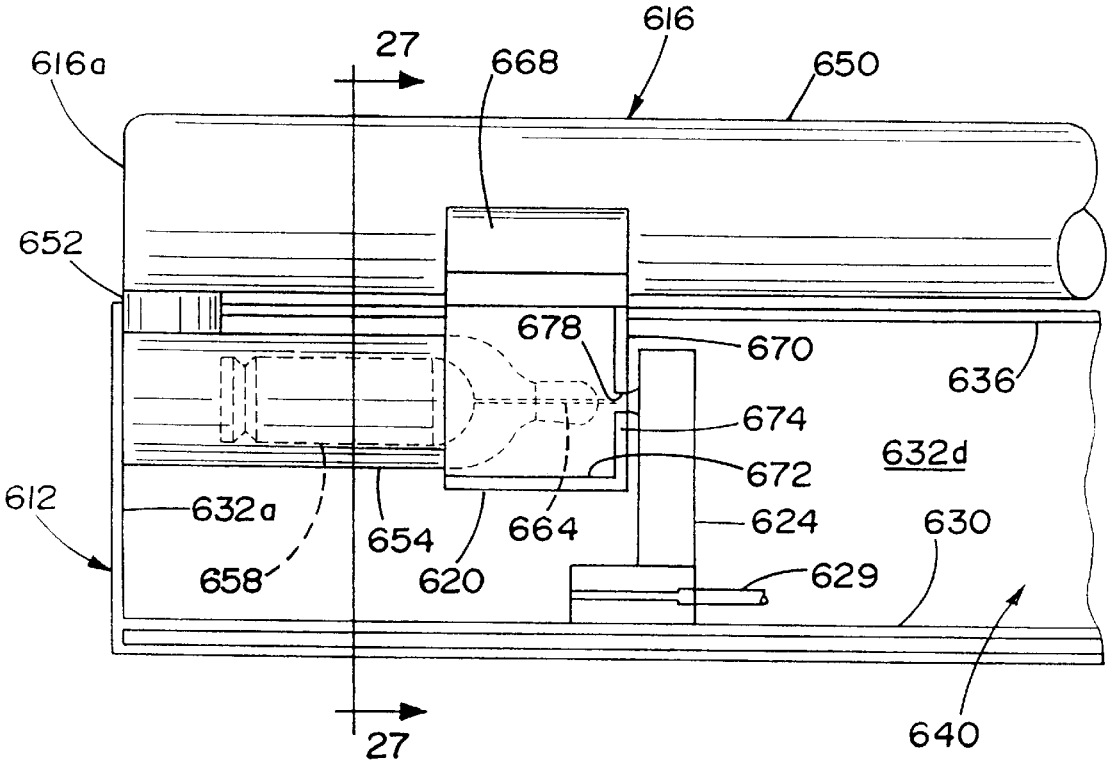
FIG. 22

FIG. 28
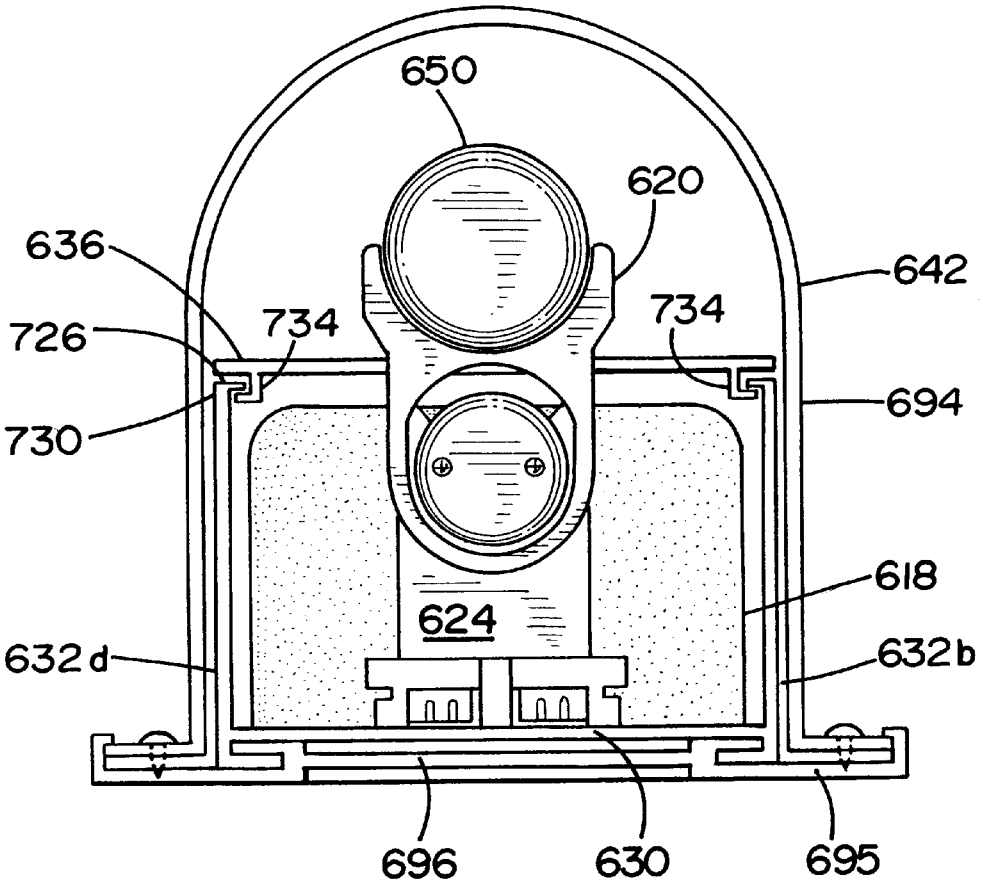
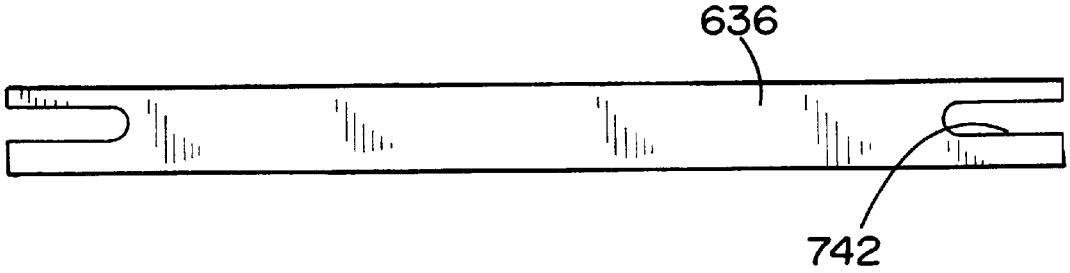
FIG. 29

LIGHTING SYSTEM

This is a continuation of International Patent Application No. PCT/US97/17723, having an international filing date of Oct. 6, 1997, pending.

This is a continuation-in-part of U.S. patent application Ser. No. 08/725,516, filed Oct. 4, 1996, which is a continuation-in-part of U.S. patent application Ser. No. 08/103,591, filed Aug. 9, 1993, now U.S. Pat. No. 5,564, 818, which is a continuation-in-part of-U.S. Pat. application Ser. No. 07/879,878, filed May 7, 1992. The entire disclosures of U.S. patent applications Ser. Nos. 08/725,516, 08/103,591 and 07/879,878 are incorporated herein by reference.

BACKGROUND OF THE INVENTION

1. Field of the Invention

The present invention relates to lighting systems, such as architectural and environmental lighting systems. The invention especially relates to cove lighting systems for residential, as well as commercial, applications.

2. Description of the Related Art

In a typical cove lighting system, lighting elements are located in an architectural recess and gently illuminate the wall and/or ceiling space adjacent the recess. Light coves are most frequently located near junctions between walls and ceilings. However, light coves may be placed in other locations, and may be provided in many orientations, including horizontal and vertical.

Cove lighting systems have many applications. For example, cove lighting systems may be used to illuminate book cases, wine and glass racks, furniture, and display-cases. Cove lighting systems may be employed anywhere that the introduction of a soft halo of light is desired.

Examples of lighting elements that have been used for cove lighting systems include incandescent bulbs, PL lamps, and standard fluorescent hot cathode lamps. As explained below, all such lighting elements have significant drawbacks for certain uses.

Incandescent bulbs are energy inefficient. Incandescent bulbs also have a short lifetime. The lifetime of a standard incandescent bulb may be only two thousand hours. Therefore, incandescent bulbs must be replaced frequently. Moreover, incandescent bulbs do not produce uniform illumination. A row of incandescent bulbs produces uneven bright and dark areas of illumination.

A PL lamp is a small diameter U-shaped gas discharge fluorescent lamp. PL lamps, like incandescent bulbs, produce uneven bright and dark areas of illumination. Moreover, PL lamps cannot be dimmed without specialized auxiliary power supplies. Another disadvantage associated with PL lamps is that they are not commercially available in colors other than white. The lifetime of a standard PL lamp is approximately ten thousand hours.

Standard fluorescent (hot cathode gas discharge) lamps are not commercially available in curved configurations suitable for cove lighting applications. Moreover, fluorescent lamps are not commercially available in colors other than white, and are not dimmable without special equipment. The rated lives of commercially available fluorescent lamps are from ten thousand to fifteen thousand hours.

Low voltage cold cathode lamps, in contrast to the lamps discussed above, are especially well suited for cove lighting applications. Cold cathode lamps are dimmable and can be relatively easily fabricated to follow a curved architectural recess without loss of light. Moreover, cold cathode lamps can be ordered in almost any color imaginable, from whites to hot pinks, vibrant blues, purples, and aquas. However, most cold cathode lamps fabricated for low voltage applications are fabricated exactly like standard hot cathode lamps. That is, the electrodes are at the ends of a straight tubular lamp, meaning that the lamp ends are dark.

The dark regions have been overcome in the past by overlapping the unilluminated end portions of the lamps in the fixture. Unfortunately, that involves longer and more expensive lamps and sometimes resulted in bright spots if the lamps overlapped too far, placing two illuminated portions side by side in the fixture. Moreover, a dark region still existed where two fixtures were placed adjacent to each other.

A cold cathode lamp is a gas discharge lamp whose electrodes are not heated to the point of thermionic emission. A hot cathode lamp is a gas discharge lamp-whose electrodes are heated to the point of thermionic emission. Because of this difference, cold cathode lamps may last much longer than hot cathode lamps. A well manufactured cold cathode lamp may last fifty thousand hours. Unlike regular hot cathode fluorescent lamps, a cold cathode lamp does not lose three hours of-its rated lifetime each time it is turned on.

Examples of cold cathode gas discharge lamps are disclosed in U.S. Pat. Nos. 5,155,668 (Tanner) and 4,004,185 (Edmondson et al.), the entire disclosures of which are incorporated herein by reference.

High voltage cold cathode lamps (including conventional neon lamps) have been used for some cove lighting applications with some success. However, high voltage lamps cannot be used in residences. According to the National Electric Code, NEC 410-75A, voltages over one thousand volts are not suitable for residential applications. Standard high voltage cold cathode lamps are particularly hazardous for residential applications. The high voltage operation of such lamps can also cause humming and buzzing noises which are unacceptable for many applications, particularly residential applications.

Another disadvantage with high voltage lamps is that the ends of such lamps electrostatically attract and incinerate dust. The resulting soot accumulates on the ceiling. The higher the voltage, the worse the problem. Eventually, the ceiling has to be repainted to cover the accumulated soot. It may be necessary to repaint the ceiling every year. To avoid the problem of soot accumulation, coves with high voltage lamps may be spaced farther away from the ceiling. However, for architectural and aesthetic reasons, it is generally advantageous to locate a cove as close to the ceiling as possible.

SUMMARY OF THE INVENTION

The present invention overcomes the problems of the prior art by providing a modular system of low voltage, cold cathode lighting fixtures connected together in parallel, with each fixture having a self-contained ballast, and with each fixture operating at a voltage of no more than about one thousand volts. The modular system may advantageously include a plurality of straight lamps and at least one curved lamp. Some of the straight lamps may be longer than the others. The modular system may be easy to install.

In a preferred embodiment of the invention, a modular system for generating light comprises a plurality of fixtures. Each fixture includes a casing, a cold cathode lamp supported by said casing, and a ballast for providing power to said lamp. The lamp includes a first tube, a second tube connected to and in fluid communication with the first tube, and a third tube connected to and in fluid communication with the second tube. Preferred embodiments of the invention include a first tube, a second tube formed at 90° from the first tube at each end of the first tube and a third tube attached to each second tube and extending parallel to the first tube. Each third tube includes a lamp electrode and is disposed between the first tube and a bottom wall of the fixture. Preferably, the fixtures are electrically connected together in parallel, with each fixture being arranged to operate at a voltage of no more than about one thousand volts.

A lamp base is provided that includes a first portion configured to surround an end of the third tube and a pair of orifices for receiving electrical leads from the electrode. The lamp base includes a second portion configured to receive and to be adhered to a portion of the first tube and protect the third tube from any torque stress or breakage when the electric-lamp is snapped into the lampholder.

In a preferred embodiment, the fixtures operate at voltages of no more than about one thousand volts. Advantageous results are achieved when the fixtures are operated at about six hundred volts. Low voltage operation may be achieved by connecting the fixtures together in parallel and by making the diameters of the cold cathode lamps about three-quarters of an inch or greater. These larger diameters are desired so that the ballast voltage will be significant enough to strike an arc within the lamp. Smaller diameter lamps (sometimes referred to as "neon lamps," with diameters of about five-eighths of an inch and smaller) are far higher in impedance and require voltages far in excess of one thousand volts to strike the arc in a lamp of the same length.

In a preferred embodiment of the invention, the modular system is available as a kit. Modularized, standard lengths of straight fixtures with integral ballasts are provided, along with similarly configured curved, angled or hinged fixtures. Each fixture is wired for easy interconnection, one to another. To install the system, the end user simply places the fixtures along the cove or other recess, connects the fixtures to each other and then connects the system to a suitable line voltage power supply.

The present invention also relates to a cold cathode cove lighting system for residential use. The system includes a cove connected to a wall. In this aspect of the invention, the lighting system is made up of a plurality of differently configured low voltage lamps supported within the cove. The lamps preferably include a first tube that is illuminated completely from end to end, including end surfaces. Thus, the lamps can be disposed adjacent each other in an end to end configuration without dark regions.

In one embodiment of the invention, the ballasts for the lamps are, located within the fixtures, such that the modular system is very easy to install.

In an alternate embodiment of the invention, the ballasts are located outside the cove to make ballast replacement or service convenient when fixtures are installed in difficult to access areas, or to produce a cove lighting system with a very narrow profile.

The casings for the fixtures may be light weight, easy to handle extruded elements. The ends of the casings may be enclosed by vertical plates. In one aspect of the invention, the casings are provided with side openings for aligning the lamps in the desired staggered relationship.

The present invention also relates to a cover for protecting the fixture from the environment. The cover is secured to the casing and sealed against high wind and water entry. The cover can be secured to the casing by mechanical fasteners, such as screws, bolts, rivets or the like, adhesives or any other suitable method. As described in more detail below, the cover may be removably connectable to a casing with a snap fit.

The present invention also relates to a multi-color gas discharge lamp having a plurality of pre-colored tubular sections spliced together to simultaneously produce different colors.

The present invention also relates to a system having a plurality of different color lamps that can be selectively dimmed to provide different resultant colors.

An object of the invention is to provide a safe, attractive, long lasting, and efficient linear continuous line-of-light lighting system.

Another object of the invention is to provide a supply of differently configured light fixtures from which fixtures of different lengths, shapes and configurations can be selected and used to create a uniform illumination cove lighting system regardless of the linear dimensions of a straight cove, and regardless of the locations of the cove's corners. Hinged and straight fixtures can be combined to illuminate circular or free form radii cove designs.

Another object of the invention is to provide a modular package of linear and non-linear light fixtures, including low voltage cold cathode light fixtures, that can be easily connected together in parallel.

Another object of the invention is to provide a dimmable lighting system with an infinitely variable light output capability.

Another object of the invention is to provide a light fixture system that dims uniformly from fixture to fixture, regardless of the lengths and shapes of the lamps.

Another object of the invention is to provide a lighting system with lamps that have long lives. The system is ideal for use in hard-to-service locations, and will reduce or even eliminate lamp replacement and associated labor costs.

Another object of the invention is to provide a lighting system that easily transitions around angles, corners and radius curves and the like, as found in residential and commercial applications. An object of the invention is to provide a lighting system that avoids the formation of dark spaces between fixtures and in the corners and curves of coves and that can be easily assembled with other lighting fixtures.

Other objects and advantages of the invention will become apparent from the following detailed description and drawings which illustrate preferred embodiments of the invention.

BRIEF DESCRIPTION OF THE DRAWINGS

FIG. 13 is a perspective view of a valance constructed in accordance with a preferred embodiment of the present invention.

FIG. 14 is an enlarged perspective view showing an end cover.

FIG. 15 is a cross sectional side view of the light fixture of FIGS. 13 and 14 installed within a wall.

FIG. 16 is a cross sectional view taken along the line 16—16 of FIG. 15.

FIG. 21 is a perspective view, partially cut away, of a lighting system constructed in accordance with a preferred embodiment of the invention.

FIG. 22 is a side view of one end of a casing and lamp of the lighting system of FIG. 21.

FIG. 28 is a section view taken along line 28—28 of FIG. 21.

FIG. 29 is a plan view of a cover plate for use with the lighting system of FIG. 21.

DETAILED DESCRIPTION OF PREFERRED EMBODIMENTS

Figure 1:
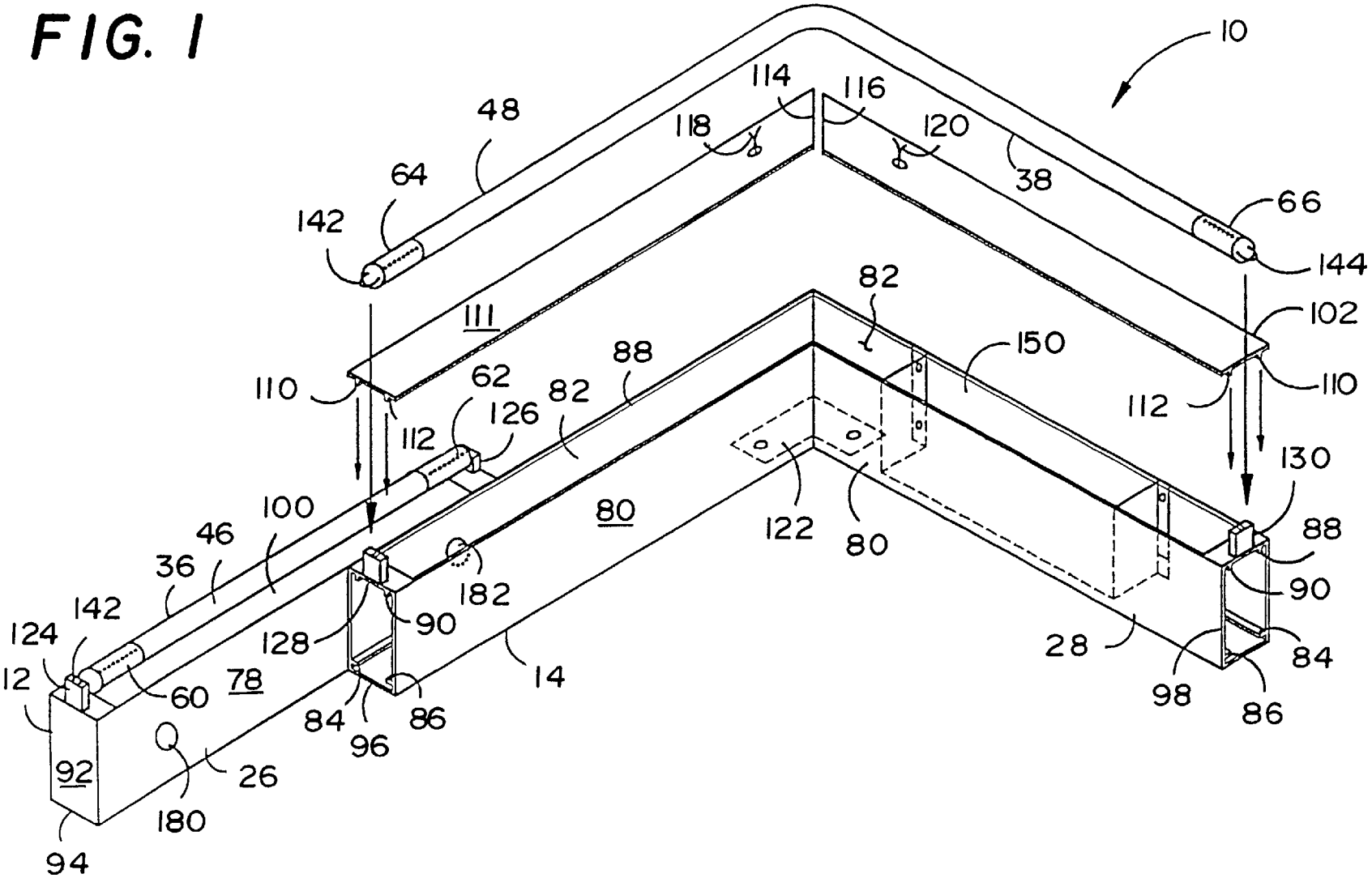
FIG. 1 is a broken away perspective partial view of a lighting system constructed in accordance with a preferred embodiment of the invention.
Figure 2:
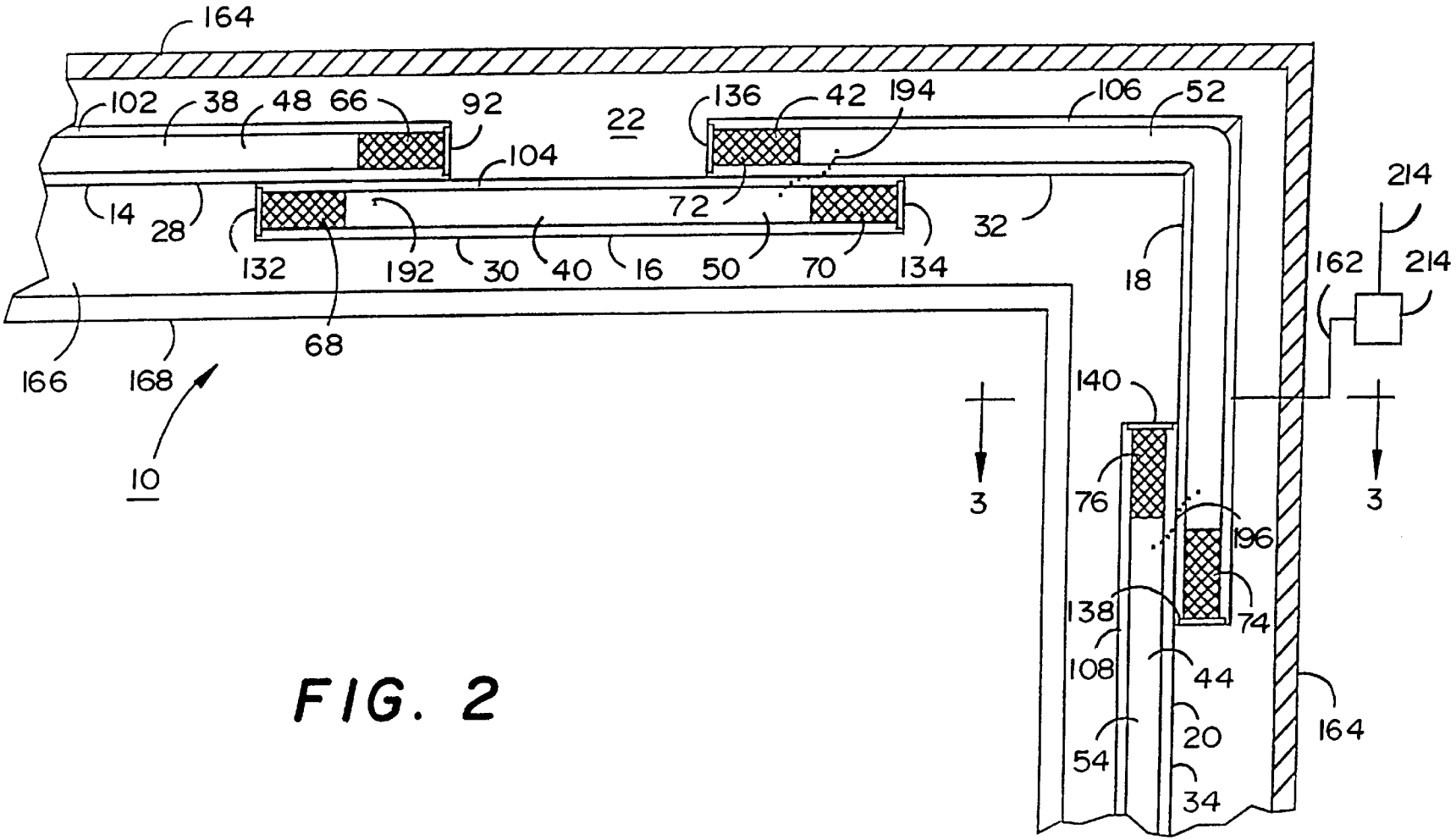
FIG. 2 is a cross sectional plan view of another portion of the lighting system of FIG. 1.
Figure 3:
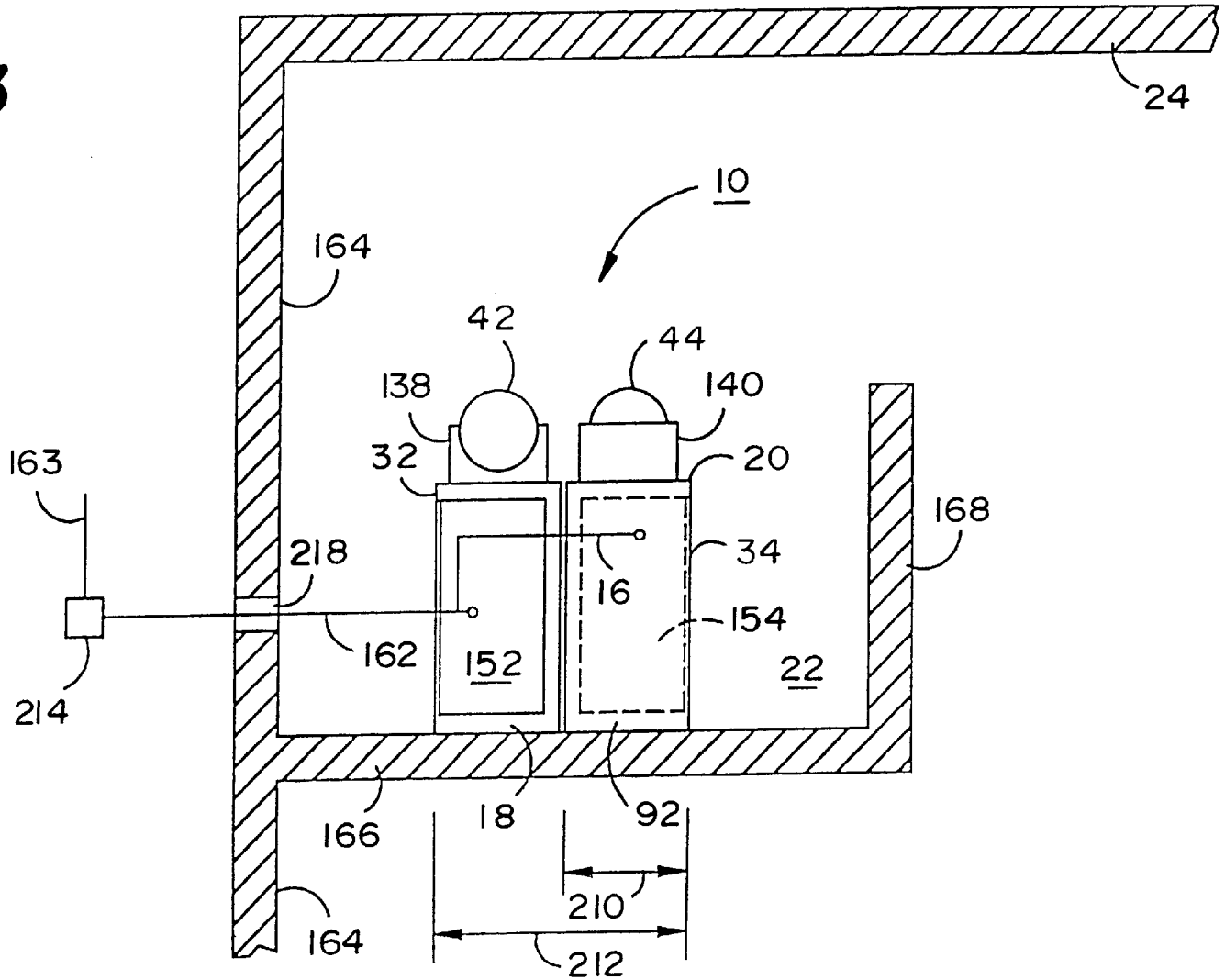
FIG. 3 is a schematic cross sectional view taken along the line 3—3 of FIG. 2.

Referring now do the drawings, wherein like reference numerals indicate like elements, there is shown in FIGS. 1–3 a modular lighting system 10 constructed in accordance with a preferred embodiment of the present invention. The lighting system 10 includes a plurality of straight and curved light fixtures 12, 14, 16, 18, 20. The system 10 is located within a cove 22 (FIGS. 2 and 3) and is arranged to illuminate a ceiling 24 (FIG. 3).

Each light fixture 12, 14, 16, 18, 20 has a casing 26, 28, 30, 32, 34 and a cold cathode lamp 36, 38, 40, 42, 44. Each lamp 36, 38, 40, 42, 44 has a tubular light transmitting body 46, 48, 50, 52, 54 and opposite opaque ends 60, 62, 64, 66, 68, 70, 72, 74, 76. As illustrated in FIGS. 1 and 2, the fixtures 12, 14, 16, 18, 20 are staggered such that the tubular light transmitting bodies 46, 48, 50, 52, 54 are slightly overlapped. Thus, the lamps 36, 38, 40, 42, 44 work together to uniformly illuminate the ceiling 24 along the entire length of the cove 22, with no bright spots and no dark spots.

Each casing 26, 28, 30, 32, 34 has an aluminum extruded main portion 78, 80 with an upper opening 82, inwardly directed, longitudinally extending lower flanges 84, 86, and inwardly directed, longitudinally extending top hooks 88, 90. A vertical, rectangular end plate 92 covers each of the ends 94, 96, 98 of the casings 26, 28, 30, 32, 34. For clarity of illustration, only one of the end plates 92 is shown in FIG. 1. The end plates 92 each have a lower flange (not illustrated) snugly received under the flanges 84, 86 of the extruded main portions 78, 80 to hold the end plates 92 in position.

Each casing opening 82 is closed by a cover 100, 102, 104, 106, 108. Each cover 100, 102, 104, 106, 108 has downwardly directed, longitudinally extending hooks 110, 112 that snap-fit into the top hooks 88, 90 to releasably connect the covers 100, 102, 104, 106, 108 to the respective main casing portions 78, 80.

Each of the casings 26, 28, 30, 32, 34 may be extruded of lightweight aluminum in accordance with Norbert Belfer Lighting Specification No. 2801, a copy of which is contained in U.S. Disclosure Document No. 297,167, filed Dec. 23, 1991. The entire disclosure of U.S. Disclosure Document No. 297,167 is incorporated herein by reference.

The covers 102, 106 for the curved fixtures 14, 18 may each be formed of two separate cover elements 111, 113 with angled adjoining ends 114, 116. Support elements 118, 120 may be located adjacent the corner formed by the angled ends 114, 116 for supporting the middle portions of the curved tubular light transmitting bodies 48, 52. Further, each curved casing 28, 32 may be formed of two separate extruded elements connected together at the corner by a suitable connecting means 122.

Bi-pin electrical sockets 124, 126, 128, 130, 132, 134, 136, 138, 140 (or single pin sockets, not shown) extend upwardly from the ends of the casings 26, 28, 30, 32, 34. The sockets 124, 126, 128, 130, 132, 134, 136, 138, 140 are used to supply electrical power through the bi-pin electrical contacts 142, 144 for the lamps 36, 38, 40, 42, 44 and to support the lamps 36, 38, 40, 42, 44 above the covers 100, 102, 104, 106, 108.

Suitable ballasts 150, 152, 154, 156, 158 (FIGS. 4 and 5) are provided for controlling the electrical power supplied to the lamps 36, 38, 40, 42, 44, particularly for limiting current through the respective lamps 36, 38, 40, 42, 44 and/or for providing starting voltages for the respective lamps 36, 38, 40, 42, 44. The ballasts 150, 152, 154, 156, 158 may be located within the casings 26, 28, 30, 32, 34. This way, each fixture 12, 14, 16, 18, 20 is a fully self-contained unit, which makes the system easy to install. Prewired leads (not illustrated) for the ballasts 150, 152, 154, 156, 158 are electrically connected to the sockets 124, 126, 128, 130, 132, 134, 136, 138, 140 by suitable electrical wires (not illustrated). The ballasts 150, 152, 154, 156, 158 are connected together in parallel to a common source of electrical power (not illustrated) by suitable electrical wires 160, 162.

A preferred ballast for use with the modular lighting system 10 is a highly reliable, cool running magnetic ballast produced by Magnatek/Jefferson of Elk Grove Village, Ill. The preferred ballast can be used for most of the differently sized and shaped fixtures 12, 14, 16, 18, 20. The preferred ballast can be tapped at any one of three different places as desired to match its lamp. In a preferred embodiment of the invention, the ballasts 150, 152, 154, 156, 158 and lamps 36, 38, 40, 42, 44 are arranged to operate at approximately .six hundred volts. A seventy two inch fixture (not shown) will operate off a separate one thousand volt ballast.

Referring now to FIG. 3, the cove 22 is located adjacent a wall 164 and includes a molding with a base portion 166 and a front portion 168. The base portion 166 extends inwardly from the wall 164 and is substantially parallel to the ceiling 24. The fixtures 12, 14, 16, 18, 20 are supported by the base portion 166. The front portion 168 extends upwardly from the base portion 166 so that the fixtures 12, 14, 16, 18, 20 are not visible to people within the residential space, and so that light from the fixtures 12, 14, 16, 18, 20 reaches the room only indirectly by reflection off the ceiling 24.

Figure 4:
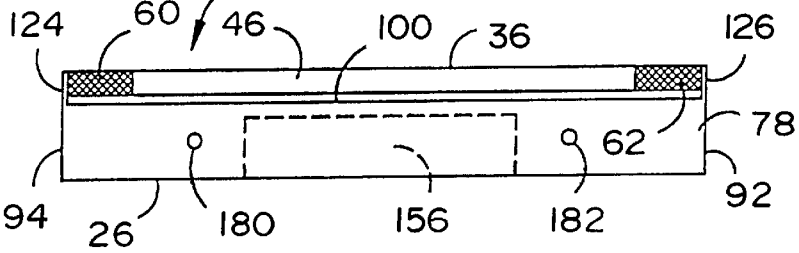
FIG. 4 is a side view of a short lighting fixture for the system illustrated in FIG. 2.
Figure 5:
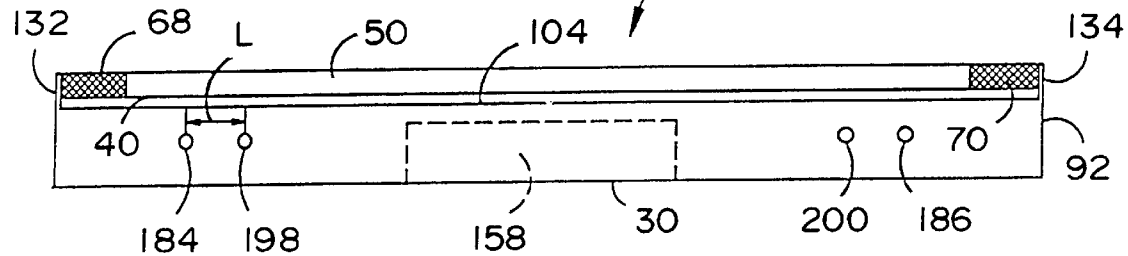
FIG. 5 is a side view of a medium lighting fixture for the system illustrated in FIG. 2.
Figure 6:
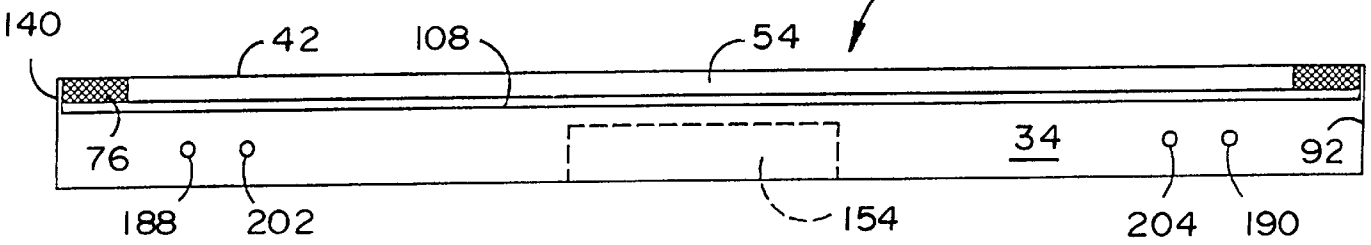
FIG. 6 is a side view of a long lighting fixture for the system illustrated in FIG. 2.

As illustrated in FIGS. 4–6, openings 180, 182, 184, 186, 188, 190 are provided through the casing sidewalls. The openings 180, 182, 184, 186, 188, 190 are used to align the casings 26, 28, 30, 32, 34 with respect to each other in the staggered format shown in FIGS. 1–3. The openings 180, 182, 184, 186, 188, 190 also provide passageways for the electrical conduits which connect the ballasts 150, 152, 154, 156, 158 together in parallel. Dashed lines 192, 194, 196 in FIG. 2 schematically designate the locations of the passageways formed by the alignment openings 180, 182, 184, 186, 188, 190.

As illustrated in FIGS. 5 and 6, the medium and long fixtures 16, 20 may be provided with additional alignment holes 198, 200, 202, 204 to accommodate cove lengths that are not divisible by the lengths of the illustrated straight and curved fixtures 12, 14, 16, 18, 20. Of course, when the additional holes 198, 200, 202, 204 are used to align the fixtures 12, 14, 16, 18, 20, a substantial overlap between adjacent light transmitting bodies will occur. The length of the overlap will be equal to the distance L between the primary alignment openings 184, 186, 188, 190 and the additional alignment openings 198, 200, 202, 204 (or two times the distance L). A light shield (FIGS. 9–11) may be used to eliminate the bright spot that would otherwise result from the use of the additional alignment openings 198, 200, 202, 204, as explained in more detail below.

Figure 17:
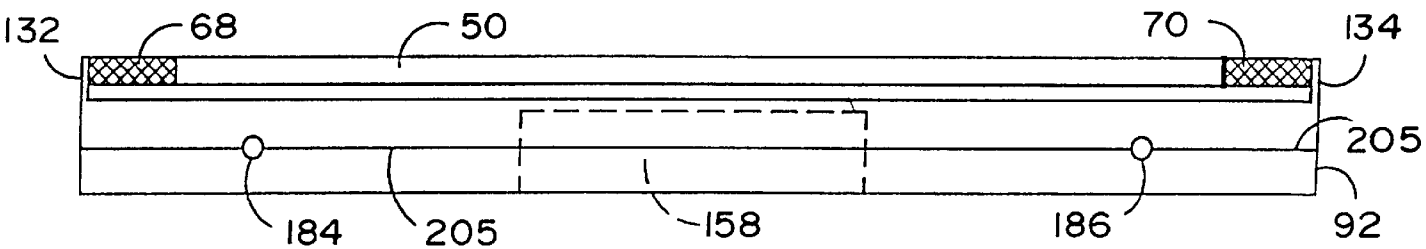
FIG. 17 is a side view of another lighting fixture for use in the system illustrated in FIG. 2.

In an alternative embodiment of the invention, illustrated in FIG. 17, the fixtures 12, 16, 20 may be provided with drill guides 205, each guide being in the form of a small groove running the length of the outside long axis of the respective extrusion. With the embodiment illustrated in FIG. 17, the ideal amount of stagger is achieved by aligning the fixtures according to the preformed openings 180, 182, 184, 186, 188, 190. If an installer needs to increase the amount of stagger, to reduce the overall length of the installation, for example to accommodate a shorter than anticipated "as built" cove length, he simply increases the amount of stagger between the last two fixtures, marks where the wires will enter the last fixture (the overly staggered fixture) and drills a hole through the side wall of the last fixture at the point of alignment with the preformed opening of the next-to-last fixture. The drill guide 205 is used to ensure that the opening drilled through the side wall of the last fixture is vertically aligned with the preformed opening of the next-to-last fixture. To eliminate the bright spot that would otherwise result from the over staggered arrangement described above, a light shield (FIGS. 9–11) may be used, as explained in more detail below.

The fixtures 12, 14, 16, 18, 20 preferably have a very small width 210 (FIG. 3). For example, the fixture width 210 may be no more than about one and three-quarters inches, such that the staggered width 212 of the lighting system 10 is no more than about three and one-half inches. Advantageously, the staggered width 212 of the lighting system 10 may be significantly smaller than the staggered width of cove lighting systems formed of conventional fluorescent fixtures, which is typically in excess of six inches.

In a preferred embodiment of the invention, the fixtures 12, 14, 16, 18, 20 would each be produced in relatively large quantities and in different colors. A lighting installer would then measure the cove within which the cove lighting system is to be installed, and then select the types and numbers of modular fixtures needed to fit the cove. The fixtures would not have to be specially manufactured for the cove.

The installation process for the system 10 may be as follows: First, the casing main portions 78, 80 are placed on the main portion 166 of the cove 22, and are staggered such that the openings 180, 182, 184,. 186, 188, 190, 198, 200, 202, 204 of adjacent fixtures are aligned. The prewired leads of the ballasts 150, 152, 154, 156, 158 are then threaded through the aligned openings 180, 182, 184, 186, 188, 190, 198, 200, 202, 204 to connect the ballasts 150, 152, 154, 156, 158 together in parallel. The ballasts 150, 152, 154, 156, 158 are then connected to a common source of electrical power. The ballasts 150, 152, 154, 156, 158 may also be connected to one or more dimmers, as explained in more detail below. The electrical connections between the ballasts 150, 152, 154, 156, 158 and the sockets 124, 126, 128, 130, 132, 134, 136, 138, 140 are preferably factory installed. Preferably, the installer only has to make the connections between the ballasts 150, 152, 154, 156, 158 and the common connection to the source of electrical power. The extruded covers 100, 102, 104, 106, 108 are then snapped onto the main portions 78, 80 to cover the openings 82, and then the ends of the lamps 36, 38, 40, 42, 44 are located within the sockets 124, 126, 128, 130, 132, 134, 136, 138, 140.

A suitable dimming system 214 (FIG. 3) may be provided for controlling the electrical power supply to the light fixtures 12, 14, 16, 18, 20. The dimming system 214 is connected to the light fixtures 12, 14, 16, 18, 20 by suitable electrical conduits 160, 162 extending through a suitable opening 218 in the wall 164. In a preferred embodiment of the invention, the lamps 36, 38, 40, 42, 44 can be uniformly and simultaneously dimmed from full brightness to a faint glow.

The fixtures 12, 14, 16, 18, 20 can be made to dim uniformly together by providing each lamp 36, 38, 40, 42, 44 with a matched ballast and gas composition. A two step process may be employed to ensure that the fixtures 12, 14, 16, 18, 20 are uniformly dimmable: First, a ballast is selected for each lamp. Second, the composition of the gas contained within the lamp (including the make-up and pressure of the gas) is adjusted so that all of the gas discharge lamps dim evenly together.

A testing system (not illustrated) may be provided for testing the ballast selection and gas adjustment. The testing system includes a dimmable power source and a milliamp meter. To test a fixture, the fixture is connected to the dimmable power source and the power source is operated according to a predetermined dimming pattern. Light output is measured in terms of the lamp's operating current. Lamp current or current density is proportional to brightness. The higher the lamp current, the brighter the lamp. Thus, the decreasing intensity of light produced by the fixture is indirectly measured by the milliamp meter and compared to a predetermined desired operating current milliamp pattern.

If the fixture does not provide the desired pattern, the ballast may be exchanged for another ballast and/or the composition of the gas may be adjusted and then the fixture may be re-tested. This process may be repeated as many times as necessary until the dimming of the fixture by the power source matches the desired pattern. Preferably, the dimmer should be able to increase or decrease the operating current of the lamps from approximately one hundred milliamps to approximately 5 milliamps evenly with no more than a plus or minus ten percent variation between different fixtures.

Figure 7:
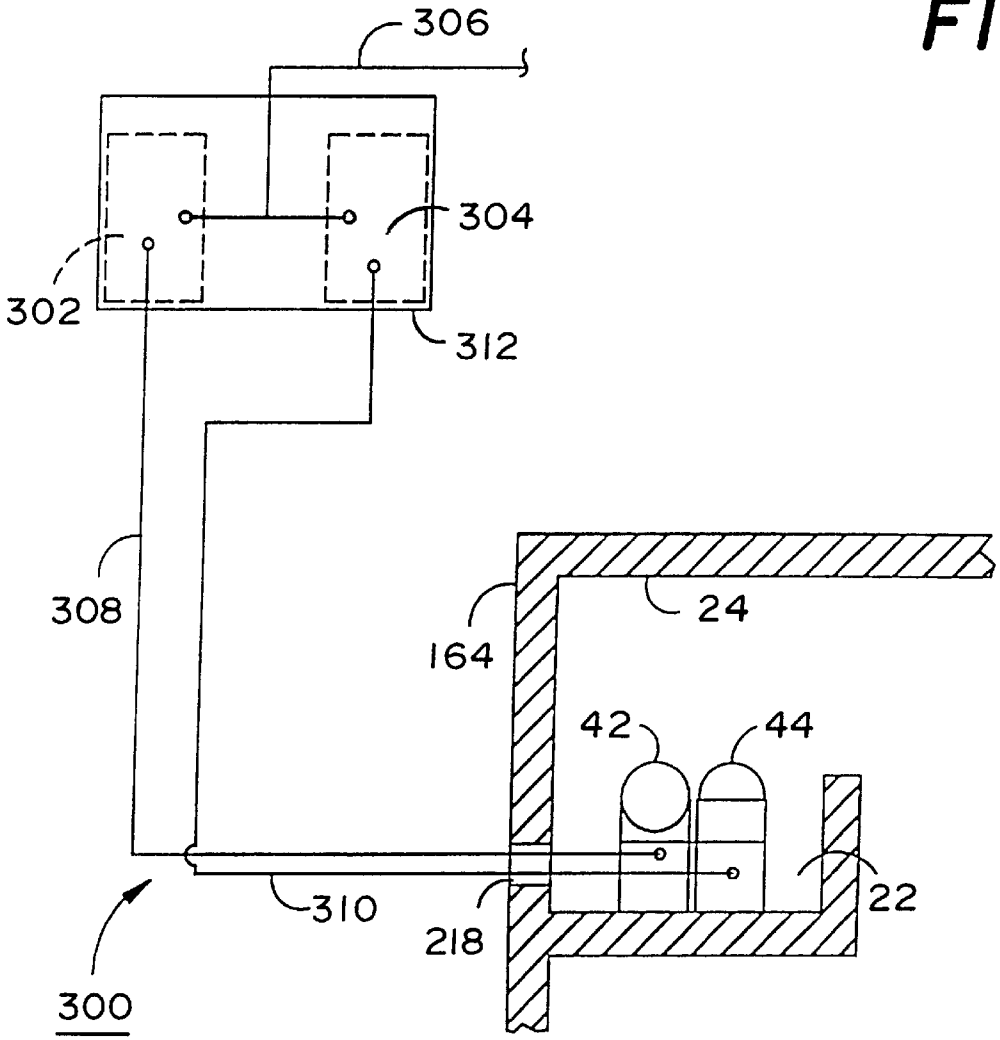
FIG. 7 is a schematic view of a lighting system constructed in accordance with another preferred embodiment of the present invention.

FIG. 7 illustrates another modular lighting system 300 constructed in accordance with the present invention. The system 300 illustrated in FIG. 7 is similar to the system 10 illustrated in FIGS. 1–6, except that the ballasts 302, 304 for the FIG. 7 embodiment are located outside the cove 22. Locating the ballasts 302, 304 outside the cove 22 may be helpful in reducing the dimensions of the lighting system 300. The ballasts 302, 304 may be identical to the ballasts 150, 152, 154, 156, 158 for the FIGS. 1–6 embodiment. Suitable means 306 may be provided for connecting the ballasts 302, 304 to a single source of electrical power (not illustrated). Suitable electrical conduits 308, 310 for connecting the ballasts 302, 304 to the lighting system 300 may extend through a suitable opening 218 in the wall 164. A housing 312 for enclosing the ballasts 302, 304 may also be provided.

Figure 8:
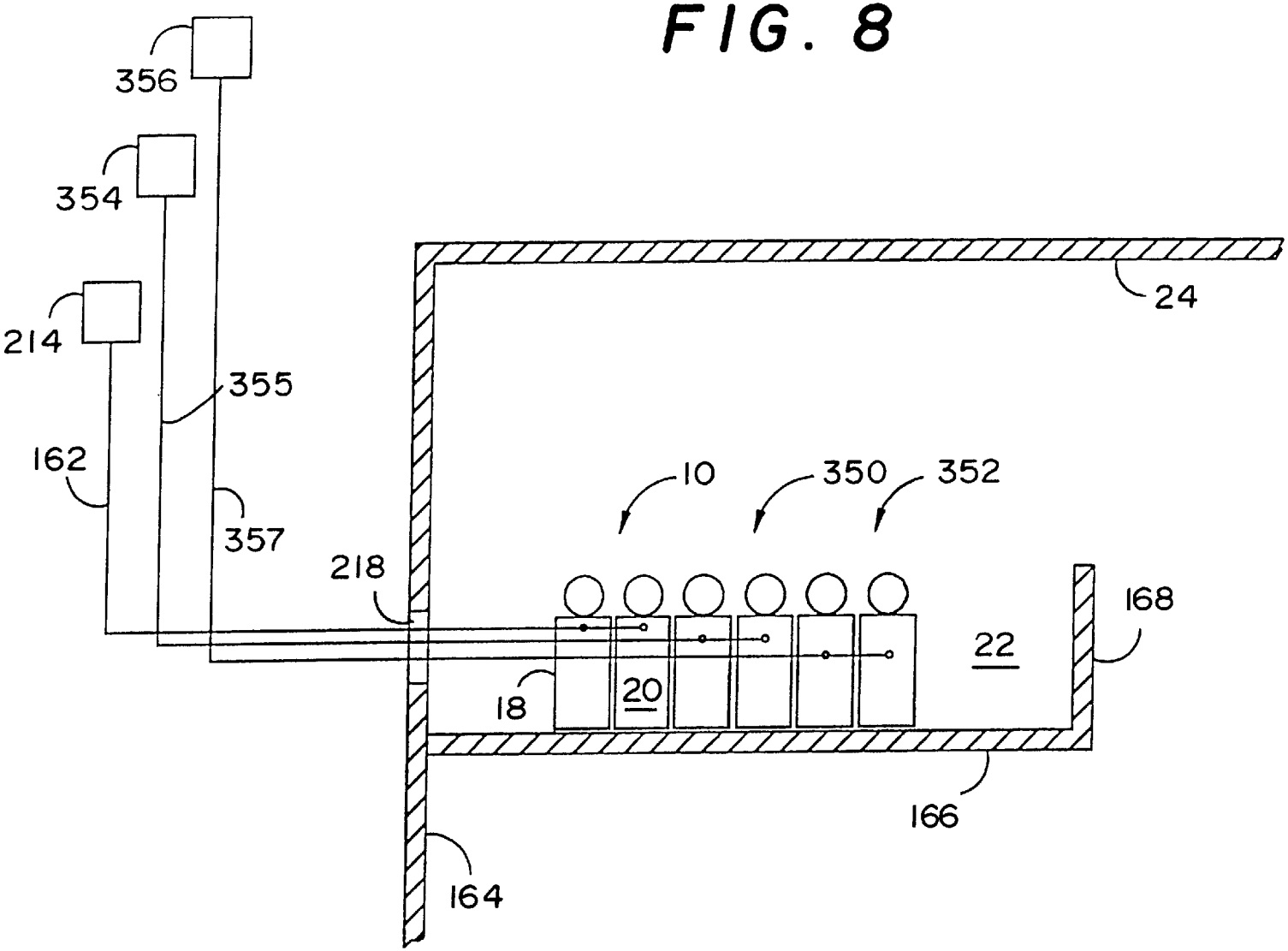
FIG. 8 is a schematic view of a lighting system constructed in accordance with another preferred embodiment of the present invention.

Referring now to FIG. 8, in another embodiment of the invention, several lighting systems 10, 350, 352 are installed next to each other within a light cove 22. The systems 10, 350, 352 are essentially identical to each other except that they produce different colors. The light systems 10, 350, 352 may produce blue, pink and white component colors, respectively. Each lighting system 10, 350, 352 has its own dimming system 214, 354, 356. The dimming systems 214, 354, 356 are connected to the respective lighting systems 10, 350, 352 by suitable electrical conduits 162, 355, 357. By controlling the intensity of the component colors generated by the systems 10, 350, 352, by selectively operating one or more of the dimming systems 214, 354, 356, a practically infinite range of resultant colors may be produced.

Figure 10:
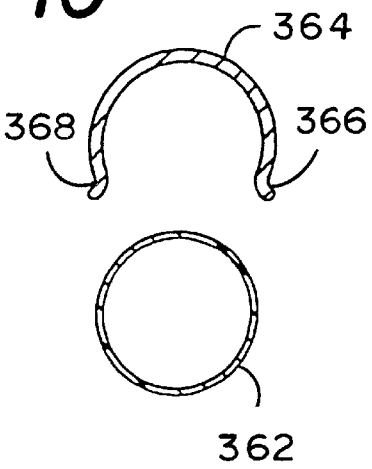
FIG. 10 is a broken away cross sectional view of the cover and overlapped lamp portion of FIG. 9, taken along the line 10—10 of FIG. 9.
Figure 11:
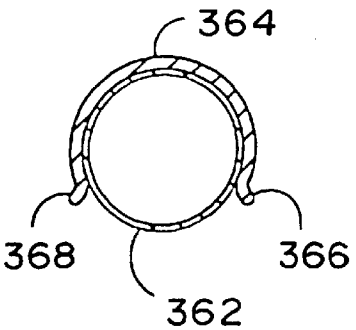
FIG. 11 is a cross sectional view of the cover and overlapped lamp portion of FIG. 10, in an assembled condition.
Figure 9:
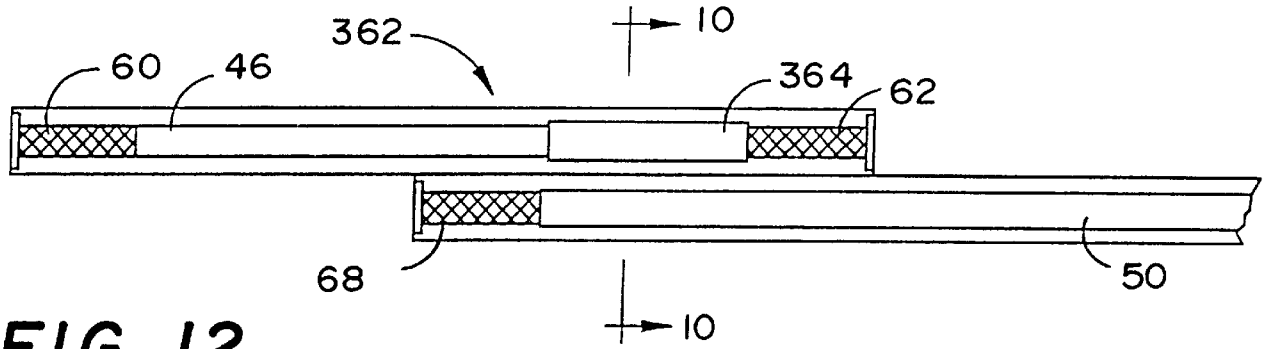
FIG. 9 is a plan view of a lighting system constructed in accordance with another preferred embodiment of the present invention.

Referring now to FIGS. 9–11, there may be times when the modular fixtures 12, 14, 16, 18, 20 do not fit within the cove 22 without a substantial overlap 362 between adjacent light transmitting bodies. As discussed above in connection with FIGS. 4–6, the length of the overlap 362 may be equal to a multiple of the distance L between the primary openings 180, 182, 184, 186, 188, 190 and the additional openings 198, 200, 202, 204. As discussed above in connection with FIG. 17, the length of the overlap 362 may be equal to the distance between the opening drilled through the drill guide 205 during installation and the adjacent preformed opening of the same fixture.

A C-shaped shield 364 (FIGS. 9–11) may be used to cover the overlapped lamp portion 362. The shield 364 may be formed of plastic so as to be lightweight and inexpensive. The shield 364 may have a constant cross section. The shield 364 may be extruded and then field cut down to the length of the overlapped portion 362.

As illustrated in FIGS. 10 and 11, the shield 364 has a C-shaped cross section with radially outwardly turned edges 366, 368. The inner diameter of the shield 364 is substantially equal to the outer diameter of the light transmitting portion 362. Assembly is accomplished by simply pushing the shield 364 down onto the overlapped lamp portion 362. The edges 366, 368 resiliently separate and then return to their original positions to hold the shield 364 in place.

Figure 12:
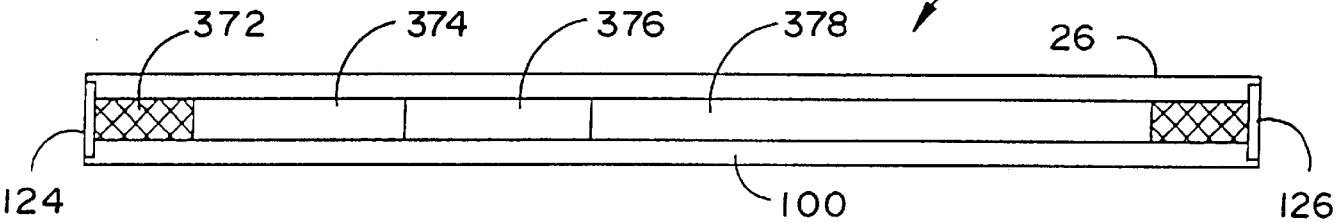
FIG. 12 is a plan view of a multi-color light fixture constructed in accordance with another preferred embodiment of the present invention.

FIG. 12 illustrates a multicolor gas discharge light fixture 370. The fixture 370 includes a casing 26 and a cold cathode lamp 372. The light fixture 370 is essentially like the straight light fixtures illustrated in FIGS. 4–6, except that the tubular light transmitting body for the multicolor fixture 370 consists of three or more different tubular sections 374, 376, 378 spliced together. Each of the sections 374, 376, 378 produces a different color. The sections 374, 376, 378 may be formed of different colored transparent glass and/or may be lined with different phosphorescent materials. Thus, the fixture 370 produces linear illumination with more than one color.

FIGS. 13–16 illustrate a system for recessing a gas discharge light fixture 12 into a wall, ceiling or the like. The illustrated system includes a valance 380 arranged to fit over a light fixture casing 26. The valance 380 has an opening 382 for receiving the light fixture lamp 36. The dimensions of the opening 382 are equal to the outer dimensions of the casing 26. A flange structure extends around the periphery of the opening 382. The flange structure includes parallel side flanges 386, 388 and parallel end flanges 390, 392. Holes 384 extend through the side flanges 386, 388 to receive screws (not illustrated) for attaching the valance 380 to the sides of the casing 26. The flanges 386, 388, 390, 392 are integrally connected to a planar skirt portion 394. As illustrated in FIGS. 15 and 16, the casing 26 may be located within a suitable opening in a wall 396 with the planar skirt portion 394 flush with the interior of the wall 396.

As illustrated in detail in FIG. 14, covers 400 may be provided for concealing the ends of the recessed light fixture 12. Each cover 400 has an open front (not illustrated), a closed back end 402, opposite side walls 404, 406 and a top 408. Identical teeth 410 may be provided at the bottom edge of each of the side walls 404, 406 for engaging respective openings 412 in the top of the casing 26. The teeth 410.snap fit into the openings 412 to removably connect the cover 400 to the casing 26.

The valance 380 and the covers 400 may be used together to provide a safe and attractive recessed light fixture.

Figure 18:
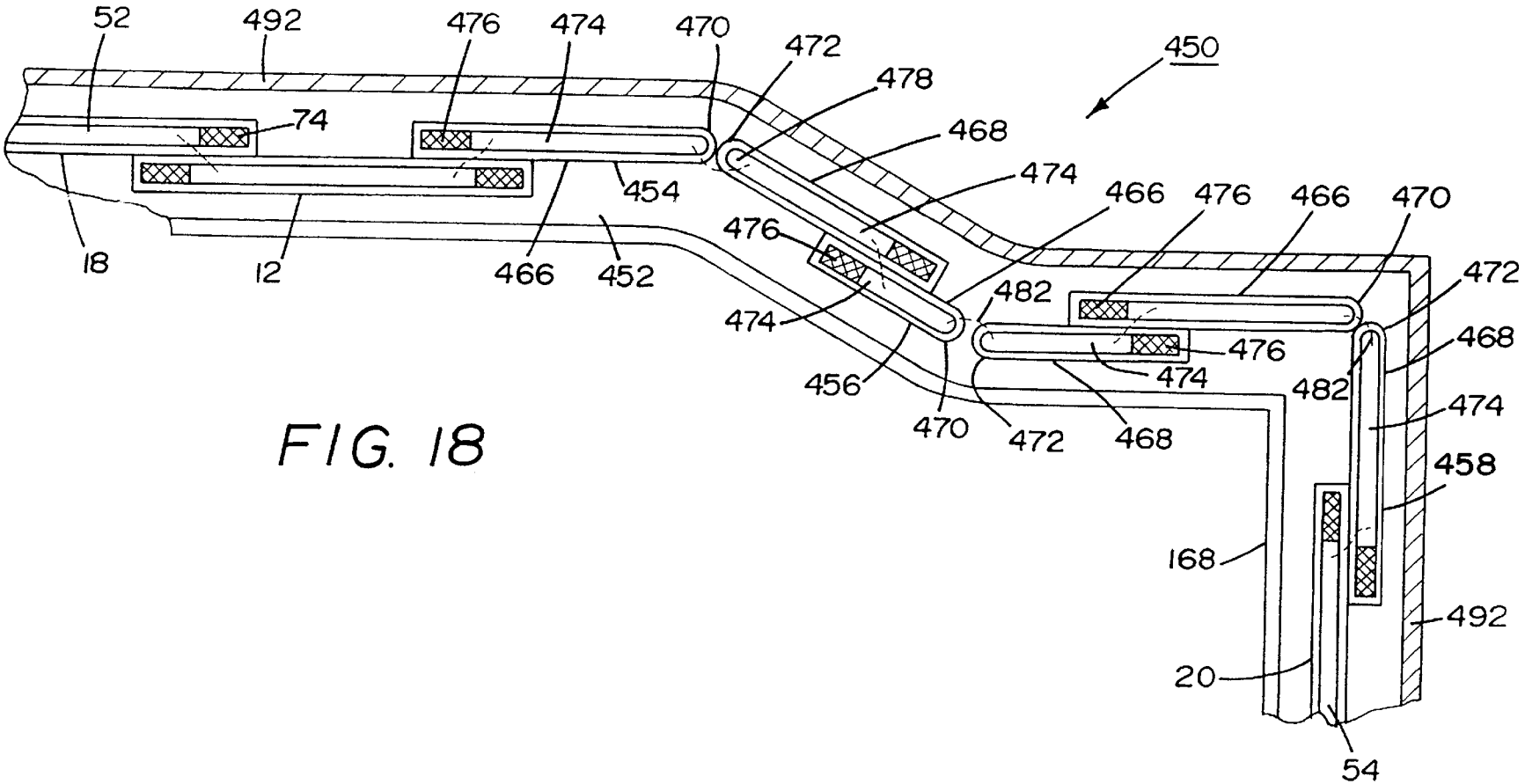
FIG. 18 is a cross sectional plan view of another lighting system constructed in accordance with a preferred embodiment of the invention.
Figure 19:
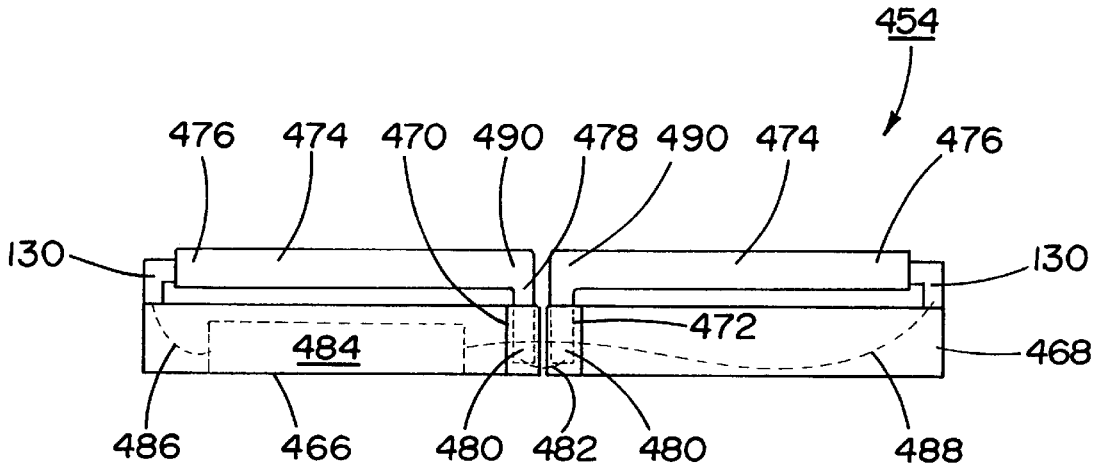
FIG. 19 is a side view of a lighting fixture for the system shown in FIG. 18.
Figure 20:
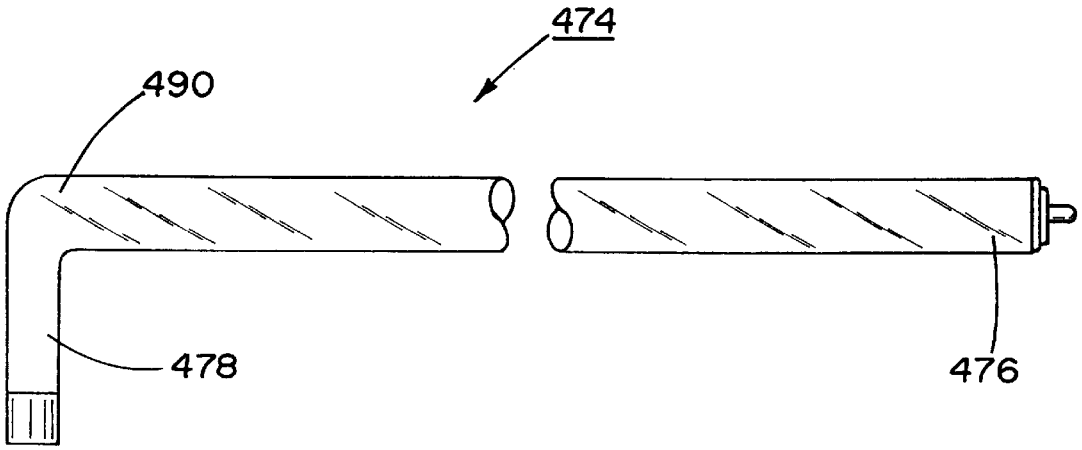
FIG. 20 is a side view of a lamp for the lighting system illustrated in FIGS. 18 and 19.

FIGS. 18–20 illustrate a modular cove lighting system 450 for use within a curved and/or multi-angled cove 452. The system 450 has hinged light fixtures 454, 456, 458 that can be used by themselves or in combination with straight and/or curved light fixtures 12, 18, 20 of the types described above. Each hinged fixture 454, 456, 458 has first and second hinged casing portions 466, 468. The casing portions 466, 468 are hinged together at their respective inner ends 470, 472. The inner ends 470, 472 are angled or rounded to permit the casing portions 466, 468 to rotate with respect to each other through angles of at least approximately 3400.

The casing portions 466, 468 each support an L-shaped (or elbow-shaped) lamp 474 (FIG. 19) having a standard fluorescent end 476 and a butt-seal end 478. The lamps 474 may be identical to each other to reduce manufacturing costs. The butt-seal ends 478 are located close to each other at the inner ends 470, 472 of the hinged casing portions 466, 468. As shown in FIG. 19, the standard fluorescent ends 476 are supported by bi-pin or single pin electrical sockets 130 and the inner ends 478 are supported by electrical connectors 480 located within the inner end portions 470, 472 of the fixtures 454, 456, 458. The butt-seal end connectors 480 may be electrically connected together by suitable electrical connectors 482 or powered as individual elements.

In the illustrated embodiment, a ballast 484 is located within each hinged light fixture 454, 456, 458. The ballast 484 is electrically connected to the respective lamps 474 by suitable means illustrated schematically by dashed lines 486, 488. Thus, the hinged lighting fixtures 454, 456, 458 can be sold separately for use in series with straight, bent and other hinged lighting fixtures of the types described above. In operation, the ballasts for all the lamps located within the cove 452 are electrically connected together in parallel.

Advantageously, the system 450 illustrated in FIGS. 18–20 can be used to provide a substantially continuous line of light on the ceiling over the hinged end portions 470, 472 of the fixtures 454, 456, 458. Thus, a continuous line of light can be provided along the entire length of a curved or angled cove. There is no dark space created between the lamps 474 because of the L-shaped configurations of the lamps 474. The elbow portions 490 of the lamps 474 are preferably located as close together as possible to provide a substantially uniform illumination on the ceiling. The standard fluorescent ends 476 may be overlapped with other lamp ends to provide uniform illumination.

The illustrated lamps 474 can be low voltage cold cathode lamps of the types described above. In another embodiment, the lamps 474 may be hot cathode fluorescent lamps.

Further, the features of the system 450 illustrated in FIGS. 18–20 can be used, as desired, with the features described above and illustrated in FIGS. 1–17. For example, the hinged casing portions 466, 468 may be constructed of extruded aluminum with casing covers and end plates. Moreover, the ballast 484 may be remotely located behind the wall 492 in the manner illustrated in FIG. 7. The lamps 474, 38, 42 may be constructed to dim uniformly, and/or they may be used with lamps of different colors in the manner illustrated in FIG. 8. In addition, the lamps 474 may have sections of different colors as shown in FIG. 12.

Likewise, the casing portions 466, 468 may have alignment holes and/or drill guides of the types described above. Preferably, the width of the fixtures 454, 456, 458 is such that the casing portions 466, 468 can be located substantially in the center of a narrow curved or angled cove. Also, the C-shaped shield 364, the valance 380 and the end covers 400 may be used in combination with the hinged fixtures 454, 456, 458.

In a preferred embodiment of the invention, illustrated in FIGS. 21–31, a lighting fixture 610 includes a casing 612 with an end-to-end illuminated cold cathode lamp 616, ballast 618, a lamp base 620 positioned at each end of the lamp 616, and an insertion lampholder 624 adjacent each lamp base 620. The casing 612 includes a bottom wall 630, a plurality of sidewalls 632*a–d,* and a cover plate 636 which cooperate to define an interior region 640. The ballast 618, lamp bases 620, and lampholders 624 are disposed within the interior region 640. A cover 642 is provided for outdoor situations requiring a fixture sealed against the environment, i.e., water-tight. Thus the fixture is particularly suitable for use in wet locations.

Figure 31:
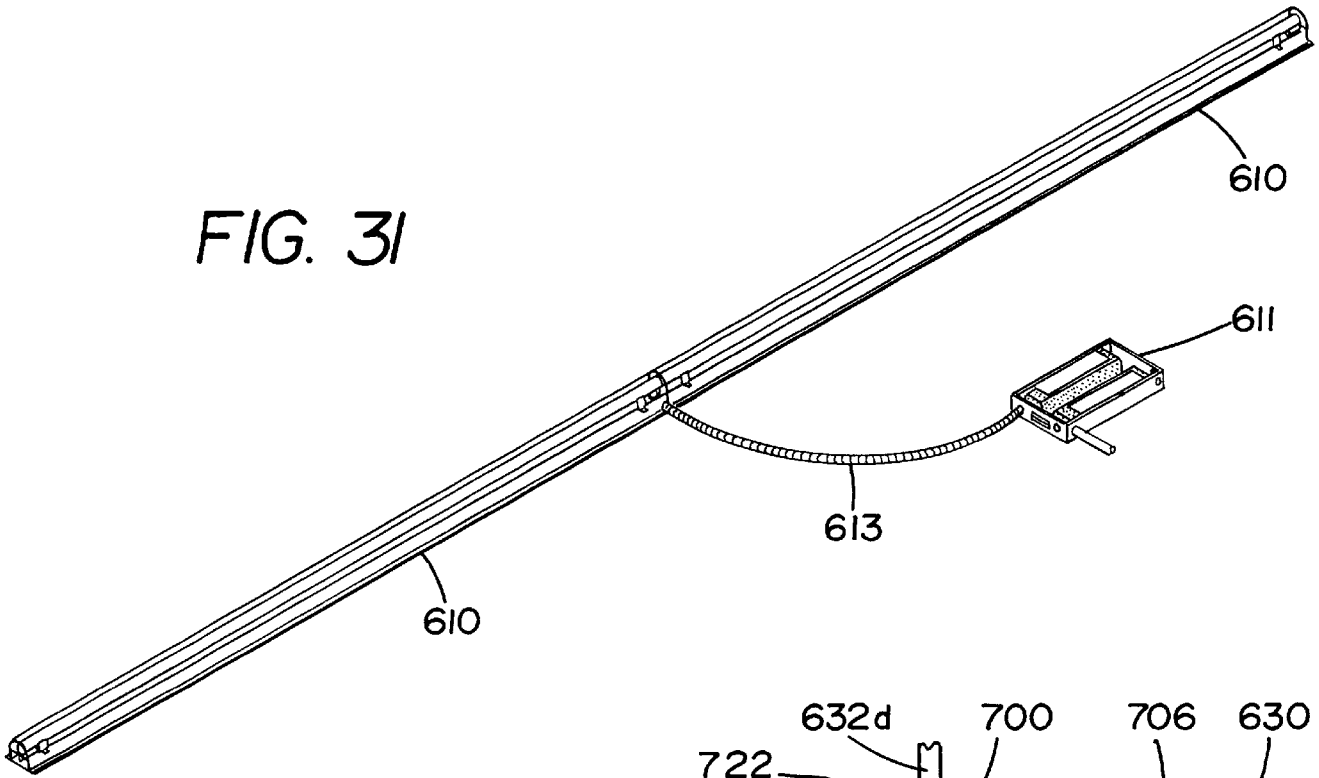
FIG. 31 is a perspective view of two lighting systems according to the invention disposed in an end to end relation, with a remote ballast.

The fixtures 610 can be placed end-to-end, as illustrated in FIG. 31 and wired in parallel. The embodiment illustrated in FIG. 31 includes a remote power supply 611 coupled to fixtures 610 by cabling 613. The fixtures 610 include concealed wire ways for running the wiring from one fixture 610 to the next. The casings 612 includes holes (not shown) in sidewalls 632*a,* 632*c* for passage of wiring from one fixture 610 to the next. Alternatively, an electrical plug and socket arrangement can be provided in the sidewalls 632*a*, 632*c* to electrically connect adjacent fixtures 610.

As illustrated in FIG. 22, a preferred lamp 616 includes a first tube 650 that is illuminated along its entire length, including flat end surfaces 616*a,* 616*b.* A pair of second tubes 652 are attached to the first tube 650 adjacent the end surfaces 616*a,* 616*b,* and a pair of third tubes 654 are attached to the second tubes 652 and disposed in parallel, spaced-apart relation with the first tube 650.

In preferred embodiments, the first, second, and third tubes are formed as a single continuous tube. For example, the first and third tubes can each be formed to include a small orifice. The tubes are heated in the vicinity of the orifices until the glass flows, whereupon the tubes are brought together to align and join the orifices. As heat is continued to be applied, a worker pulls the first and third tubes apart and simultaneously blows into an end of the third tube to force the plastic glass to flow outwardly to form the second tube.

The second and third tubes 652, 654 are disposed relative to the first tube 650 so that they lie between the planes of the flat end surfaces 616*a,* 616*b.* The third tube 654 encloses an electrode 658 and includes a pair of passages for passing electrode leads 664 out of the third tube 654. Although commercially available electrodes that fit in the third tube 654 are acceptable, another preferred electrode is the Hi-Slim™ electrode manufactured by Oldham Lighting, Ltd. The first, second and third tubes 650, 652, 654 are in fluid communication with each other.

Figure 23:
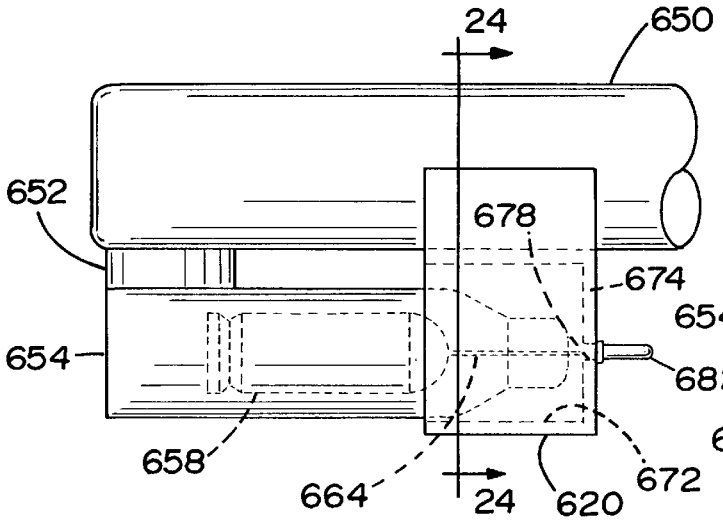
FIG. 23 is a side view of one end of the lamp of FIG. 22.
Figure 24:
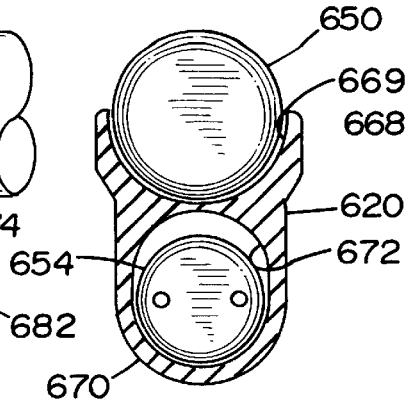
FIG. 24 is a section view taken along line 24—24 of FIG. 23.
Figure 25:
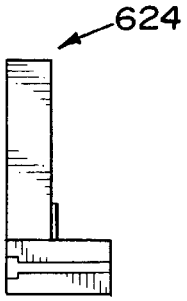
FIG. 25 is a side view of a lampholder for use with the lighting system of FIG. 21.
Figure 26:
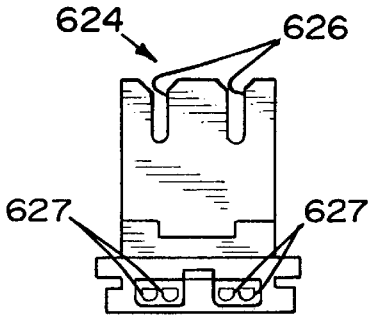
FIG. 26 is a front view of the lampholder of FIG. 25.

The lamp bases 620, illustrated in FIGS. 22–24, include a first portion 668 forming a longitudinally extending semicircular channel 669 configured to adhere to and to cradle the first tube 650, and a second portion 670 having an elongated circular shaped channel 672 configured to receive and protect the third tube 654, allowing it to "float" and not receive any torque stress when the lamp is installed or removed from the lampholder. An end wall 674 closes the channel 672 at one end and includes a pair of orifices 678 extending therethrough for receiving the electrode leads 664. The orifices 678 are fitted with hollow copper or brass electrical connectors 682 (FIG. 23) such that the electrode leads 664 can be inserted into the connectors 682 and soldered in place. The connectors 682 extend from the end wall 674 away from the third tube 654 and generally parallel to the longitudinal axis of the third tube 654.

Previous end-to-end illuminated cold cathode lamps were configured with 90° lamp electrodes. That is, the lamp electrodes were sealed on at the lamp ends, and extended at right angles away from the lamp. This tubular glass element containing the lamp electrode would extend anywhere from three, to four and one half inches away from the lamp. Each lamp end would have an integral brass ferrule base for making electrical contact into specialized lampholders. Pressing the lamps into, or removing them from the lampholders creates no stress or breakage hazard on the lamp electrode because no bending moment exists. This system works well but creates an undesirable high fixture height. These fixtures with long electrodes on the lamps can reach dimensions of six inches in overall height.

Tucking the lamp electrode underneath the lamp, and utilizing the specialized lamp base as in the preferred embodiment of this invention allows a greatly reduced fixture height while still allowing the top insertion and removal feature of the lamp into the fixture. Without the specialized lamp base which transfers all the stress of lamp insertion and removal to the sturdy body of the lamp, any effort to insert or remove the lamp from any type of lampholder would create a tremendous torque on the bending moment of the lamp electrode and would cause it to instantly crack or shatter.

Previous methods utilized to electrically connect lamps made in the above fashion consisted of hand wiring an electrical lead to each lamp end. Removal of lamps required the same removal of the wiring by hand. This allowed lamps to be installed with little or no stress of torquing of the lamp electrode. Lamp installation in this manner is successful but extremely labor intensive and subject to miswiring or wiring coming undone over time creating a fire hazard. This type of electrical connection of fluorescent lamps is not recognized by Underwriter's Laboratories.

The lamp bases 620 advantageously provide a unique way to use conventional lampholders 624 to electrically connect a uniquely manufactured end-to-end illuminated lamp in a lighting fixture that is illuminated completely from end-to-end. Additionally, the lamp bases 620 allow the use of end-to-end lighted fixtures without the necessity of hard wiring the lamp into the casing.

The lampholders 624, illustrated in FIGS. 22 and 25–28, are mechanically affixed to the bottom wall 630 of the casing. The lampholders 624 are of conventional design and include a pair of slots 626 for receiving the connectors 682. The slots 626 are electrically connected to orifices 627 in the base of the lampholder 624. The orifices 627 receive electrical leads 629 (FIG. 22) from the ballast 18. These circuit interrupt lampholders 624 are commercially available from numerous suppliers.

Figure 27:
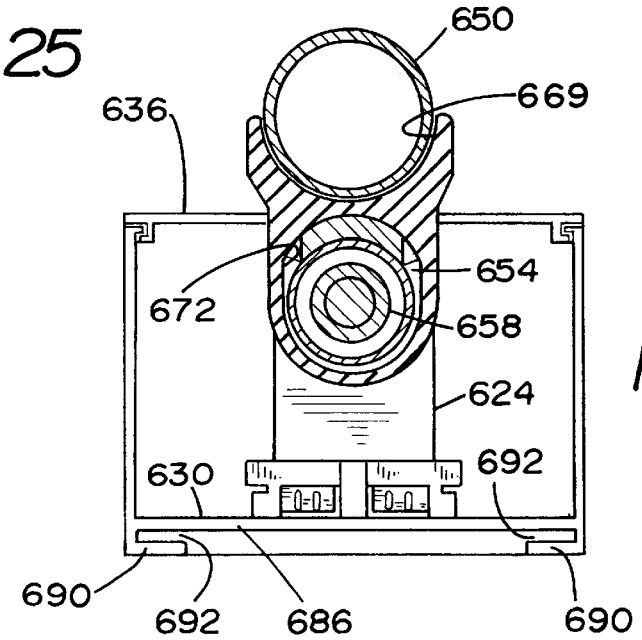
FIG. 27 is a section view taken along line 27—27 of FIG. 22.

As illustrated in FIG. 27, the bottom wall 630 of the casing 612 includes a bottom surface 686 and a pair of opposing first L-shaped rails 690. The first L-shaped rails 690 extend longitudinally along the length of the casing 612 and project downwardly and inwardly from the surface 686 to form opposing inwardly opening channels 692.

Figure 30:
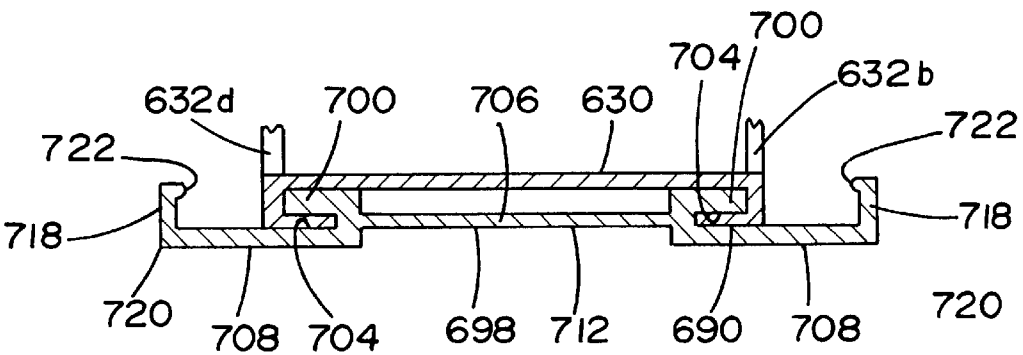
FIG. 30 is partial transverse section taken through the casing showing the bottom wall of the casing and the cover retaining member.

The cover 642 includes a canopy 694 with a retaining lip 695 (FIG. 28), and a canopy-retaining member 696 (FIG. 30). A preferred canopy 694 is an inverted U-shaped member, either transparent or translucent, that extends longitudinally along the length of the casing 612 and around three sides and both ends of the casing 612. The retaining lip 695 extends outwardly from each end of the inverted U-shaped member to engage the canopy-retaining member 696 along the lengths of sidewalls 632*b* and 632*d*. The canopy is mechanically secured to the casing and retaining lip and rendered weather-tight via retaining screws, brackets and gasketing.

The canopy-retaining member 696 (FIG. 30) includes a base plate 698 having a pair of opposing second L-shaped rails 700 extending longitudinally along the length of the member 696 and projecting upwardly and outwardly from the upper surface 706 of the base plate 698. A pair of longitudinally extending lower plates 708 project outwardly from the bottom surface 712 of the base plate 698 and parallel thereto. The second L-shaped rails 700 cooperate with the lower plate 708 to form outwardly opening channels 704 configured to receive the first L-shaped rails 690. The second L-shaped rails 700 interfit with the first L-shaped rails 690, as illustrated in FIG. 30, to attach the canopy-retaining member 696 to the casing 612.

Each lower plate 708.includes a retaining wall 718 extending upwardly from the outermost edge 720 of the lower plate 708. A cover-retaining bead 722 extends inwardly from the upper edge of each retaining wall 718. The lower plate 708, retaining wall 718 and retaining bead 722 are configured to receive the retaining lip 695, as illustrated in FIG. 28. Preferably, the cover 642 is configured to resiliently urge the lip 695 into contact with the retaining wall 718 and retaining bead 722.

The sidewalls 632*b*, 623*d* include a bead 726 (FIG. 28) extending longitudinally along the upper edge 730 of the sidewalls 632*b*, 632*d* and projecting inwardly therefrom. The cover plate 636 includes a pair of longitudinally extending L-shaped rails 734 projecting downwardly and outwardly from the lower surface 738 of the cover plate 636. The L-shaped rails 734 interfit with the bead 726 to attach the cover plate 636 to the sidewalls 632*b*, 632*d*. The cover plate 636 also includes a pair of openings 742 (FIG. 29) extending longitudinally from the ends of the plate 636 for allowing passage of the third tubes 654 and lamp bases 620 into the interior region 640 while the cover plate 636 is in position.

Advantageously, the lamp bases 620 permit insertion of the lamp 616 into the lampholder while protecting the electrode leads 668 and preventing damage to the lamp 616. The lamp base 620 spreads the insertion force necessary to push or remove the connectors 682 into or out of the receiving slots 626 over a wide area of the first tube 650 and prevents any force or torque from being applied to the second and third tubes 652, 654. It will be appreciated that other configurations can be used that retain the connectors 682 in a predetermined position relative to the first tube 650. An advantageous feature of the lamp base 620 is its ability to use a rigid coupling between the first tube and the connectors to eliminate stress at the second tube-first tube joint and at the third tube-second tube joint.

Another advantage of the present invention is the use of cold cathode lamps that illuminate completely from end to end. This feature allows the lamps to be placed end to end to provide the illusion of a single continuous lamp by eliminating dark regions from between adjacent lamps. By retaining the second and third tubes 652, 654 between the planes of the end surfaces 616*a*, 616*b*, adjacent lamps 616 can be placed to minimize the gap between them and enhance the illusion of a single lamp.

The above description and drawings are only illustrative of preferred embodiments which can achieve the objects, features, and advantages of the present invention. It is not intended that the invention be limited to the embodiments shown and described herein. For example, the invention has been described with respect to cold cathode lamps, but it is equally desirable for use with other fluorescent lamps. Moreover, the lamps indicated in the various embodiments were shown with the same design on both ends. The lamps can be manufactured with different designs on opposing ends. For example, the three tube design of FIGS. 21–31 can be used on one end of a lamp while another design, such as the one illustrated in FIGS. 1–17, can be used on the opposing end. Likewise, one end can include the design illustrated in FIGS. 18–20 while the opposing end of the lamp can include one of the other illustrated designs. Modifications of the invention coming within the spirit and scope of the following claims are to be considered part of the present invention.

What is claimed as new and desired to be protected by Letters Patent of the United States is:

1. A lamp base for use with a lamp having a first tube illuminated along its entire length, a second tube connected to the first tube and a third tube connected to the second tube, the first, second and third tubes being in fluid communication, the third tube being disposed in parallel spaced-apart relation with the first tube and enclosing an electrode, the lamp base comprising a first portion for supporting the first tube and a second portion for supporting the third tube, such that said electrode is located between said second tube and said lamp base, the first and second portions cooperating to retain the first and third tubes in spaced-apart relation.

2. The lamp base of claim 1, wherein the second portion includes a pair of electrical contacts for electrically coupling the lamp to a lighting fixture, the electrical contacts being configured to receive a pair of electrode leads from the third tube.

3. A method of making an end-to-end illuminated lamp for use with a lampholder, the method comprising the steps of:

forming a first tube and a third tube, said third tube being shorter than said first tube;

forming a second tube to connect the first and third tubes; and providing a lamp base.

4. The method of claim 3 wherein the lamp base provides an automatic circuit interrupt when the lamp is removed from the lampholder.

5. A method of using a lampholder with an end-to-end illuminated lamp, the method comprising the steps of:

providing a lamp having a first tube, a third tube disposed in a parallel relation to the first tube, and a second tube connecting the first and third tubes;

providing an electrode in said third tube;

providing a lamp base configured to receive the first tube and prevent torque stress from being applied to the lamp as electrode leads connected to said electrode are installed or removed from the lampholder; and locating said electrode between said lamp base and said second tube.

6. The method of claim 5 wherein the lamp base includes a first portion coupled to the first tube and a second portion surrounding a portion of the third tube.

* * * * *